US006016106A

United States Patent [19]

Ohtsuki

[11] Patent Number: 6,016,106

[45] Date of Patent: Jan. 18, 2000

[54] PAGING SYSTEM

[75] Inventor: Michihito Ohtsuki, Shizuoka, Japan

[73] Assignee: NEC Corporation, Tokyo, Japan

[21] Appl. No.: 08/806,108

[22] Filed: Feb. 25, 1997

[30] Foreign Application Priority Data

Feb. 26, 1996 [JP] Japan ..... 8-038188

[51] Int. Cl.[7] ..... G08B 5/22

[52] U.S. Cl. ..... 340/825.44; 340/311.1; 340/825.69; 379/93.05

[58] Field of Search ..... 340/825.44, 311.1, 340/825.69; 379/93.05

[56] References Cited

U.S. PATENT DOCUMENTS

| | | | |
|---|---|---|---|
| 5,291,192 | 3/1994 | Ichikawa et al. | 340/825.44 |
| 5,396,228 | 3/1995 | Garahi | 340/311.1 |
| 5,561,702 | 10/1996 | Lipp et al. | 340/825.44 |
| 5,574,439 | 11/1996 | Miyashita | 340/825.44 |
| 5,583,921 | 12/1996 | Hidaka | 379/93.05 |

FOREIGN PATENT DOCUMENTS

| | | |
|---|---|---|
| 0 536 831 A1 | 4/1993 | European Pat. Off. . |
| 04132320 | 5/1992 | Japan . |
| 4-132320 | 5/1992 | Japan . |
| 2 263 569 | 7/1993 | United Kingdom . |
| WO 95/05646 | 2/1995 | WIPO . |

*Primary Examiner*—Michael Horabik
*Assistant Examiner*—Yves Dalencourt
*Attorney, Agent, or Firm*—Scully, Scott Murphy & Presser

[57] ABSTRACT

A paging system having a selective calling receiver which receives a selective call signal transmitted from a base station. The selective call signal including message information. The paging system including: a display for obtaining a corresponding regular message from the message information and displaying the regular message; a divider for dividing the received message information into predetermined set units; a memory for storing predetermined message information and the message information divided into the set units; and a counter for incrementing the frequency of the set unit message information to be stored in the memory if the message information is the same as set unit message information which has been stored previously.

7 Claims, 5 Drawing Sheets

FIG. 4

| PREDETERMINED MESSAGE NUMBER | CONTENTS OF PREDETERMINED MESSAGE | FREQUENCY |
|---|---|---|
| O 1 | PLEASE | 2 O |
| O 2 | GOOD MORNING | 1 8 |
| O 3 | CO., LTD. | 1 2 |
| O 4 | 4 9 4 9 | 8 |
| O 5 | AWAIT | 7 |
| O 6 | YOKOHAMA | 4 |
| O 7 | YOKOSUKA | 4 |
| O 8 | EXCUSE ME | 3 |
| O 9 | 4 2 8 5 2 | 3 |
| 1 O | O 3 - 3 3 3 3 - 3 3 3 3 | 2 |

FIG. 5A

PLEASE CALL 03-3333-3333

FIG. 5B

PLEASE
CALL
03-3333-3333

FIG. 5C

[ [ 01 CALL [ [ 10

PAGING SYSTEM

BACKGROUND OF THE INVENTION

1. Field of the Invention

The present invention relates to a paging system and, more particularly, to a paging system having a selective calling receiver which receives and displays message information.

2. Description of the Prior Art

As one of conventional techniques of this type, a selective calling receiver described in Japanese Unexamined Patent Publication No. 4-132320 can be presented.

This conventional selective calling receiver comprises a message conversion memory which stores in advance message conversion information for converting compacted message information into regular message information corresponding to the compacted message information, and a message conversion means for, when message information included in a received selective call signal is compacted message information, converting the compacted message information into regular message information in accordance with the message conversion information stored in the message conversion memory and displaying the regular message information.

However, for the conventional selective calling receiver, both the calling station and the called station must know the text of the compacted message. Additionally, the calling station must use a compacted message which is checked by a supplementary means such as a predetermined message table.

Since the knowledge and cumbersome operation are required for the calling station, the calling station hesitates to perform call originating with compacted message information. Therefore, the use frequency is lowered to reduce the traffic, and the transmission amount of message information increases, resulting in a decrease in line efficiency.

SUMMARY OF THE INVENTION

The present invention has been made in consideration of the above situation in the prior art, and has as its object to provide a paging system which increases the use frequency of stereotype information without causing the calling station to perform a cumbersome operation and also reduces the transmission amount of message information, thereby increasing the line efficiency.

In order to achieve the above object, according to the basic aspect of the present invention, there is provided a paging system having a selective calling receiver which receives a selective call signal transmitted from a base station, comprising display means for, when the selective call signal is a call to the selective calling receiver and includes message information, obtaining a corresponding regular message from the message information and displaying the message, division means for dividing the received message information into predetermined set units, memory means for storing predetermined message information and the message information divided into the set units, and count means for counting the set unit message information to be stored in the memory means if the message information is the same as set unit message information which has been stored previously.

The display means according to the basic aspect displays contents of the message without performing any processing when the regular message is obtained, and displays a corresponding predetermined message when the predetermined message information is received. In addition, the set units are word units.

The memory means according to the basic aspect has a storage area of a frequency of the divided and counted message information, and stores the divided message information in the storage area of the predetermined message information in descending order of frequencies.

The selective calling receiver comprises a radio unit for receiving a radio signal including address information and message information from the base station, a decoder for receiving a signal from the radio unit and decoding the signal, a first memory unit for storing the predetermined message information, a word unit message, and a frequency, a first message analyzing unit for analyzing a message read out from the first memory unit, a message conversion unit for converting the message information received subsequent to the address information into a displayable message by using the stereotype information stored in the first memory unit when it is determined on the basis of an analysis result from the first message analyzing unit that the predetermined message information is included in the message information, and a first control unit for performing reception processing of the radio signal, notification processing of message reception, and display processing of the displayable message.

On the other hand, the base station comprises a transmission unit for transmitting a radio signal including address information and the message information to the selective calling receiver, a second memory unit for storing the predetermined message information, a word unit message, and a frequency, a second message analyzing unit for analyzing a message read out from the second memory unit, a predetermined message conversion unit for converting the predetermined message information from the second memory unit into a predetermined message on the basis of an analysis result from the second message analyzing unit, and a second control unit for controlling the transmission unit, the predetermined message conversion unit, the second message analyzing unit, and the second memory unit.

Furthermore, the base station comprises retransmission means for retransmitting the message information when an omission is present in the selective call signal transmitted to the selective calling receiver.

As is apparent from the above aspect, according to the present invention, a message with a high use frequency is actively transmitted as a predetermined message in units of selective calling receivers. Since the message is compacted, the transmission amount can be reduced, resulting in an increase in line efficiency.

The above and many other advantages, features and additional objects of the present invention will become manifest to those versed in the art upon making reference to the following detailed description and accompanying drawings in which preferred embodiments incorporating the principles of the present invention are shown by way of illustrative example.

BRIEF DESCRIPTION OF THE DRAWINGS

FIG. 4 is a table showing an example of predetermined message used in the embodiment of the present invention; and FIGS. 5A to 5C are views showing a transmission message, a message after word division, and a message after conversion, respectively, so as to explain message processing in the message conversion operation of the embodiment of the present invention.

DETAILED DESCRIPTION OF THE PREFERRED EMBODIMENT

A preferred embodiment of the present invention will be described below with reference to the accompanying drawings.

Figure 1:
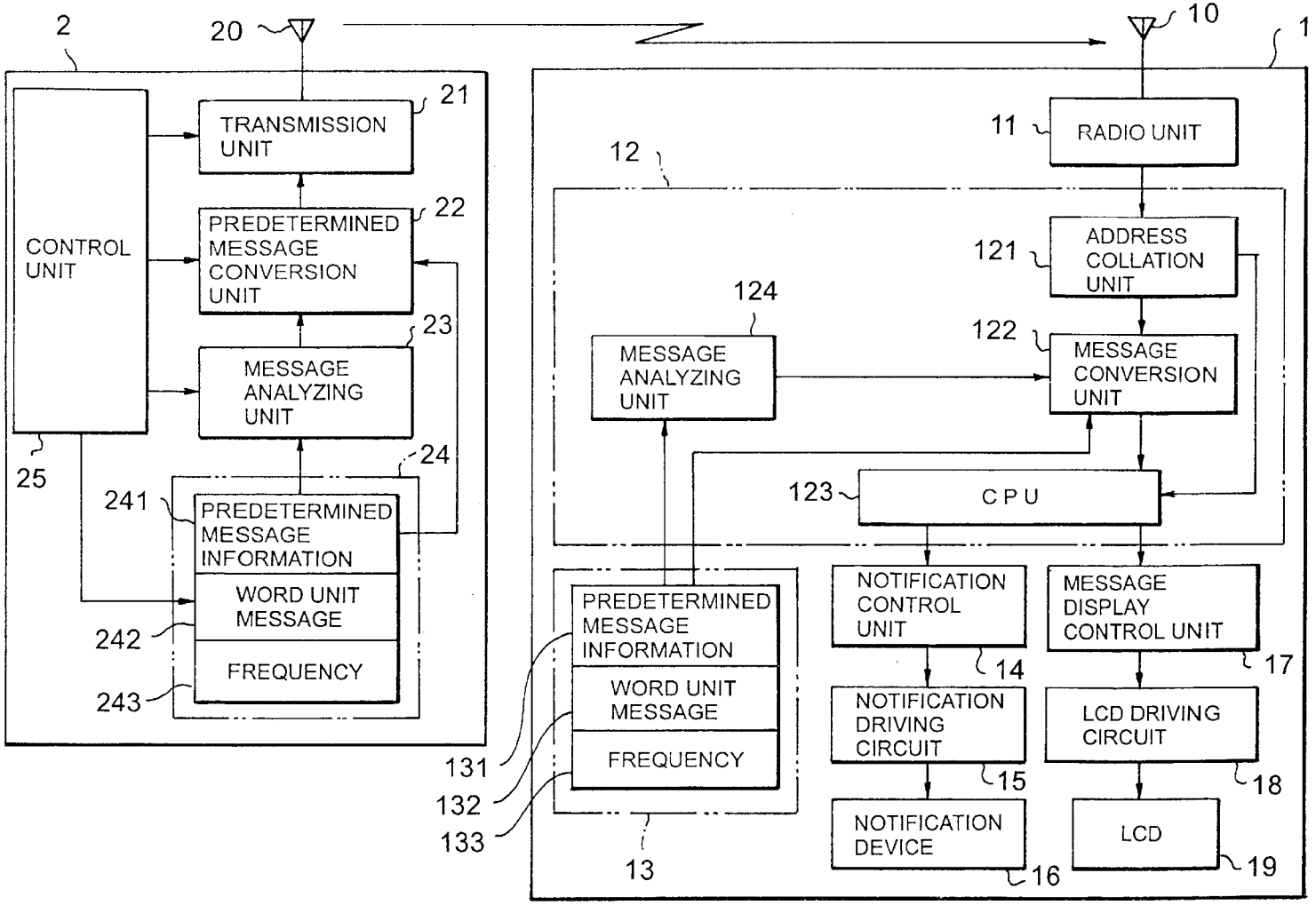
FIG. 1 is a block diagram showing the overall arrangement of a paging system according to an embodiment of the present invention.
Figure 2:
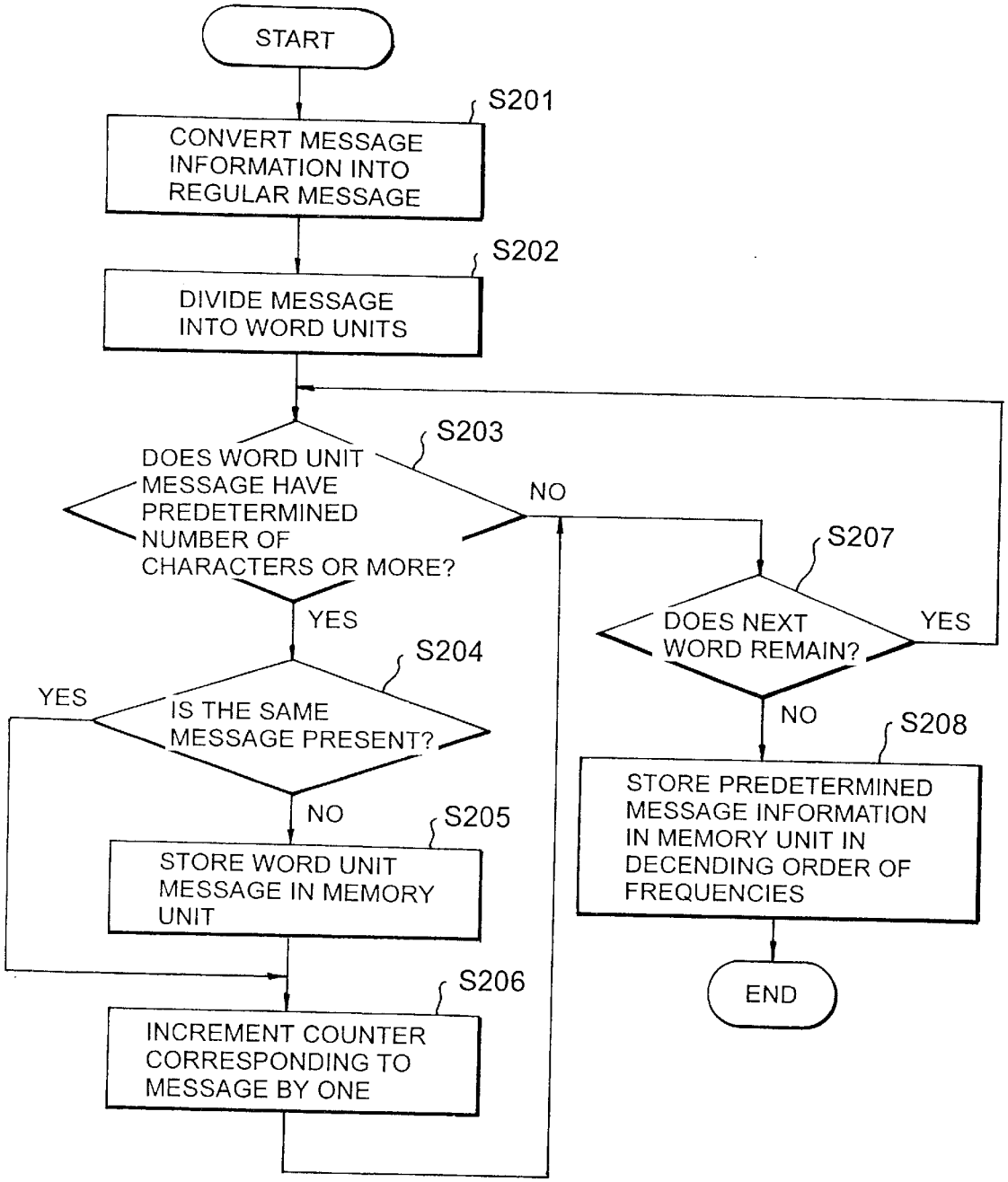
FIG. 2 is a flow chart showing procedures of a message analyzing operation in the embodiment shown in FIG. 1.
Figure 3:
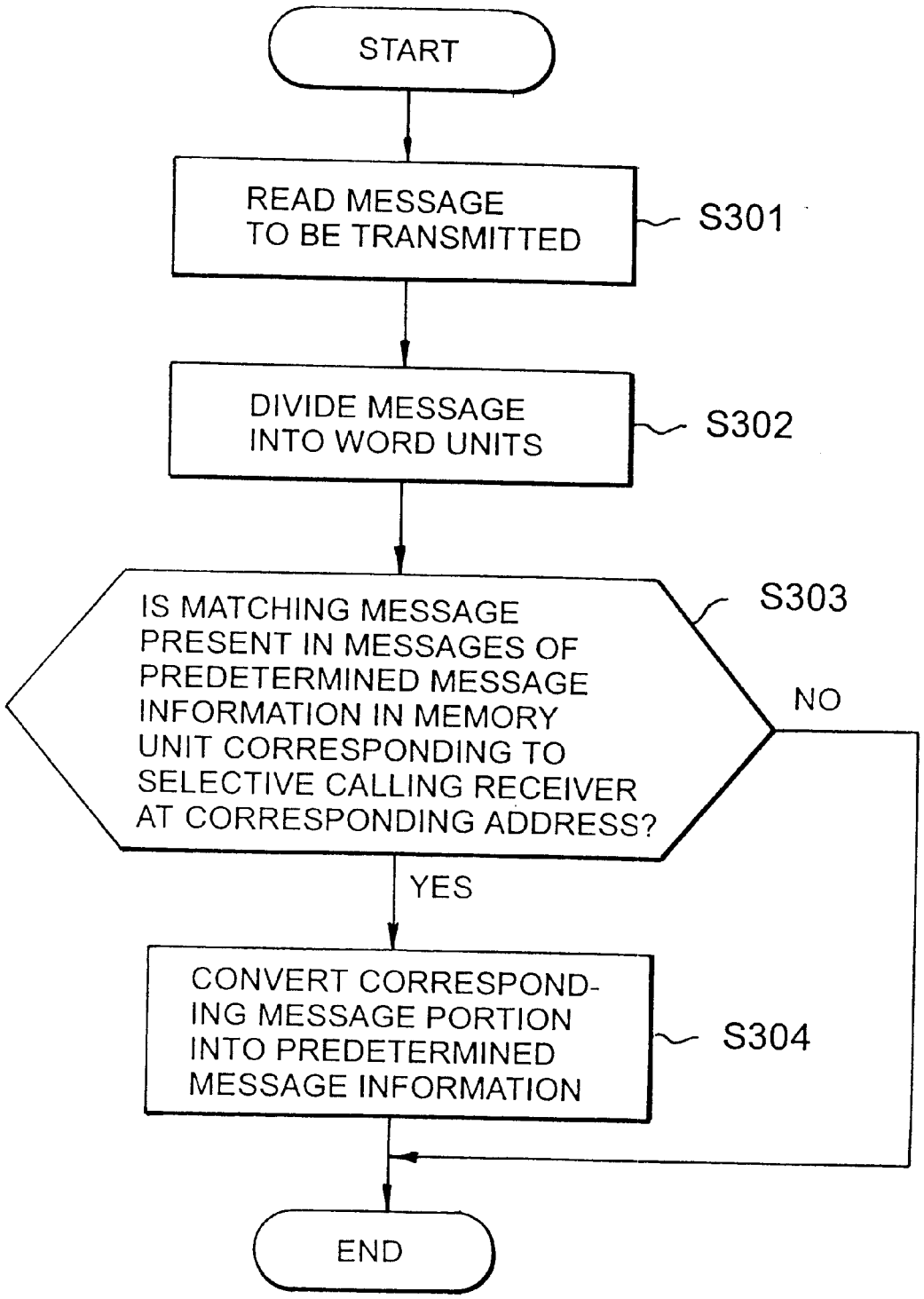
FIG. 3 is a flow chart showing procedures of a message conversion operation in the embodiment shown in FIG. 1.

FIG. 1 is a block diagram showing a paging system according to an embodiment of the present invention. FIG. 2 is a flow chart showing procedures of a message analyzing operation in the paging system shown in FIG. 1. FIG. 3 is a flow chart showing procedures of a message conversion operation in the paging system shown in FIG. 1.

FIG. 4 is a table showing an example of predetermined message used in the embodiment of the present invention. FIGS. 5A to 5C are views showing a transmission message, a message after word division, and a message after conversion, respectively, so as to explain the processes of message processing in the message conversion operation in this embodiment.

Referring to FIG. 1, a paging system according to an embodiment of the present invention is constituted by a selective calling receiver 1 and a base station 2.

The selective calling receiver 1 comprises a radio unit 11 for receiving a radio wave from the base station 2 via an antenna 10, a decoder 12 for receiving a signal from the radio unit 11 and decoding the signal, a memory unit 13 for storing predetermined message information 131, a word unit message 132, and a frequency 133, a notification control unit 14 for notifying that the decoder 12 has received a message, a notification driving circuit 15 for driving a notification device 16 in accordance with an instruction from the notification control unit 14, a message display control unit 17 for controlling display of information when the message converted by the decoder 12 includes predetermined message information, and an LCD driving circuit 18 for driving an LCD 19 in accordance with an instruction from the message display control unit 17.

The decoder 12 has an address collation unit 121, a message conversion unit 122, a CPU 123, and a message analyzing unit 124. The address collation unit 121 collates the address number of a signal received from the radio unit 11 with the address number of the selective calling receiver 1. If the address collation unit 121 detects coincidence of the addresses, the message conversion unit 122 receives a message signal subsequent to the signal. If the message signal includes predetermined message information, the predetermined message information is converted into a displayable message by using the predetermined message information 131 stored in the memory unit 13.

The CPU 123 performs reception processing of the radio signal. After the information is converted into a message, the CPU 123 controls the notification driving circuit 15 through the notification control unit 14 to cause the notification device 16 to perform an operation of notifying the reception of the message signal. The CPU 123 also controls the LCD driving circuit 18 through the message display control unit 17 to cause the LCD 19 to display the received message.

The operation of the this embodiment will be described with reference to FIG. 2.

The message conversion unit 122 converts message information including predetermined message information or the like into a regular message to be displayed (step S201).

The message analyzing unit 124 receives this regular message and divides the message into word units as shown in FIG. 5B (S202).

If the divided word unit message need not be converted into a predetermined message, i.e., the length of the word unit message is smaller than that of predetermined message information (e.g., four characters), the message is not subjected to conversion (S203).

If the word has a sufficient length (YES in step S203), it is checked whether the word is stored in the memory unit 13 as the word unit message 132 (S204). If NO in step S204, the message of this word is stored in a free area (S205), and the counter of this message is set at "1" (S206). If YES in step S204, the counter of the message is incremented by one (S206).

After step S206 or if NO in step S203, i.e., if the length of the word unit message is smaller than that of the predetermined message information, the operations in steps S203 to S206 are repeated for the next word. If no word is present anymore (S207), messages are sequentially stored in the predetermined message information storage area in descending order of counters stored in the frequency storage area.

For the same frequency, a message having a larger length is stored first. For the same message length, a message which has registered latest is stored first.

In the predetermined message table of FIG. 4, a predetermined message with a high frequency has a small ordinal number of predetermined message. For the same frequency, (e.g., frequency=3), predetermined message "EXCUSE ME" (eight characters) has an ordinal number smaller than that of predetermined message "42852" (five characters). For the same frequency (e.g., frequency=4) and message length, "YOKOHAMA" which has lately been registered is registered with an ordinal number smaller than that of "YOKOSUKA".

Referring back to FIG. 1, the base station 2 comprises a transmission unit 21 for transmitting address information and message information to the selective calling receiver 1 via an antenna 20, a memory unit 24 for storing predetermined message information 241, a word unit message 242, and a frequency 243, a message analyzing unit 23 for analyzing a message read out from the memory unit 24, a predetermined message conversion unit 22 for converting predetermined message information from the memory unit 24 into a predetermined message in accordance with the analysis result from the message analyzing unit 23, and a control unit 25 for controlling the transmission unit 21, the predetermined message conversion unit 22, the message analyzing unit 23, and the memory unit 24.

An operation of transmitting a message from the base station 2 will be described with reference to FIGS. 3, 4, and 5A to 5C.

In accordance with an instruction from the control unit 25, the message analyzing unit 23 reads out, from the memory unit 24, the address information of the selective calling receiver 1 as a transmission destination and message information to be transmitted (step S301). This readout message information is divided into word unit messages (S302).

For each of the divided messages, the predetermined message table shown in FIG. 4 is read out from the memory unit 13 of the selective calling receiver 1 designated by the address information, and it is checked whether a predetermined message matching the word unit message is present (S303).

If YES in step S303, i.e., if a matching message is present, the message is regarded as a predetermined message. The predetermined message conversion unit 22 converts this message into the predetermined message information on the basis of the predetermined message table (S304). For all the divided messages, the procedures in steps S303 and S304 are executed.

As shown in FIG. 5A, if the message to be transmitted is "PLEASE CALL 03-3333-3333" (character length: 22 characters), the message obtained upon converting the message by the predetermined message conversion unit 22 using the predetermined message table is "[[01 CALL [[10" (character length: 12 characters), as shown in FIG. 5C. Therefore, the character length of the transmission message is reduced by 10 characters. FIG. 5B shows an example of word unit division of a message in the memory unit 24.

When conversion of all predetermined message is completed by the predetermined message conversion unit 22, the transmission unit 21 adds the address information of the selective calling receiver 1 on the reception side to the converted message and transmits the message on a radio wave from the antenna 20.

Upon completion of this transmission, the message analyzing unit 23 of the base station 2 analyzes the message transmitted to the selective calling receiver 1 before message conversion.

In some cases, the message transmitted from the base station 2 is not received by the selective calling receiver 1, i.e., an omission is present. If an omission is present, the base station 2 detects this omission. The control unit 25 of the base station 2 performs processing (not shown) of retransmitting the predetermined message information to equalize the arrangements of predetermined message on the transmission and reception sides (on the base station side and on the selective calling receiver side).

In this embodiment, a message is divided into word units. However, the present invention is not limited to this. A message may be divided into sentence units or specific character number units (e.g., five character units) from the top of the message. Alternately, a combination of sentence units and word units may be used.

In this embodiment, the divided message length is set to four characters. However, any number may be set as long as the number is larger than the length of stereotype information.

In this embodiment, using frequencies as a determination reference, messages to be stored in the predetermined message table are sequentially stored in descending order of frequencies. However, in consideration of the message efficiency, a value may be obtained by multiplying a frequency by a value calculated by subtracting the number of characters (four characters) of predetermined message information from the message length, and this value may be used as the determination reference to sequentially store messages in descending order of the values.

What is claimed is:

1. A paging system having a selective calling receiver which receives a selective call signal transmitted from a base station, the selective call signal including message information, the paaing system comprising:

display means for obtaining a corresponding regular message from the message information and displaying the regular message;

division means for dividing the received message information into predetermined set units;

memory means for storing predetermined message information and the message information divided into the set units; and count means for incrementing the freguencv of the set unit message information to be stored in said memory means if the message information is the same as set unit message information which has been stored previously.

2. A system according to claim 1, wherein said display means displays contents of the regular message without performing any processing when the regular message is obtained, and displays a corresponding predetermined message when the predetermined message information is received.

3. A system according to claim 1, wherein the set units are word units.

4. A system according to claim 1, wherein said memory means has a storage area of a frequency of the divided and counted message information, and stores the divided message information in the storage area of the predetermined message information in descending order of frequencies.

5. A system according to claim 1, wherein said selective calling receiver comprises a radio unit for receiving a radio signal including address information and message information from said base station, a decoder for receiving a signal from said radio unit and decoding the signal, a first memory unit for storing the stereotype information, a word unit message, and a frequency, a first message analyzing unit for analyzing a message read out from said first memory unit, a message conversion unit for converting the message information received subsequent to the address information into a displayable message by using the predetermined message information stored in said first memory unit when it is determined on the basis of an analysis result from said first message analyzing unit that the predetermined messaae information is included in the message information, and a first control unit for performing reception processing of the radio signal, notification processing of message reception, and display processing of the displayable message.

6. A system according to claim 1, wherein said base station comprises a transmission unit for transmitting a radio signal including address information and the message information to said selective calling receiver, a second memory unit for storing the predetermined message information, a word unit message, and a frequency, a second message analyzing unit for analyzing a message read out from said second memory unit, a predetermined message conversion unit for converting the predetermined messaae information from said second memory unit into a predetermined message on the basis of an analysis result from said second message analyzing unit, and a second control unit for controlling said transmission unit, said Predetermined message conversion unit, said second message analyzing unit, and said second memory unit.

7. A system according to claim 6, wherein said base station comprises retransmission means for retransmitting the message information when an omission is present in the selective call signal transmitted to said selective calling receiver.

* * * * *